US011178748B2

(12) United States Patent
Taniguchi

(10) Patent No.: US 11,178,748 B2
(45) Date of Patent: Nov. 16, 2021

(54) PARTICLE ACCELERATION SYSTEM AND PARTICLE ACCELERATION SYSTEM ADJUSTMENT METHOD

(71) Applicant: SUMITOMO HEAVY INDUSTRIES, LTD., Tokyo (JP)

(72) Inventor: Manami Taniguchi, Ehime (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 16/460,509

(22) Filed: Jul. 2, 2019

(65) Prior Publication Data

US 2019/0327824 A1 Oct. 24, 2019

Related U.S. Application Data

(63) Continuation of application No. PCT/JP2017/002530, filed on Jan. 25, 2017.

(51) Int. Cl.
*H05H 13/00* (2006.01)
*H05H 1/30* (2006.01)
*H05H 7/08* (2006.01)

(52) U.S. Cl.
CPC ..... *H05H 13/005* (2013.01); *H05H 1/30* (2013.01); *H05H 7/08* (2013.01); *H05H 2007/082* (2013.01)

(58) Field of Classification Search
None
See application file for complete search history.

(56) References Cited

U.S. PATENT DOCUMENTS

| | | | | |
|---|---|---|---|---|
| 6,635,889 | B2 | 10/2003 | Tsukihara et al. | |
| 7,273,996 | B2 | 9/2007 | Marriott et al. | |
| 7,436,075 | B2 | 10/2008 | Ando | |
| 8,183,539 | B2 * | 5/2012 | Huang | H01J 37/05 250/281 |
| 2002/0096650 | A1 * | 7/2002 | Tsukihara | H01J 37/08 250/492.1 |
| 2007/0262269 | A1 * | 11/2007 | Trbojevic | A61N 5/10 250/492.3 |
| 2012/0132802 | A1 * | 5/2012 | Arai | H01J 37/28 250/310 |
| 2016/0189913 | A1 * | 6/2016 | Eisner | H01J 37/3171 250/396 ML |

(Continued)

FOREIGN PATENT DOCUMENTS

| | | | |
|---|---|---|---|
| JP | S63-289751 | A | 11/1988 |
| JP | H04-111200 | A | 9/1992 |

(Continued)

OTHER PUBLICATIONS

International Search Report issued in Application No. PCT/JP2017/002530, dated May 9, 2017.

*Primary Examiner* — Amy Cohen Johnson
*Assistant Examiner* — James H Cho
(74) *Attorney, Agent, or Firm* — Michael Best & Friedrich LLP

(57) ABSTRACT

A particle acceleration system includes an ion source that generates an ion, an accelerator that accelerates the ion, And a transporting unit that transports the ion from the ion source to the accelerator, in which an attachment angle and an attachment position of the ion source with respect to the transporting unit are able to be adjusted.

5 Claims, 4 Drawing Sheets

(56) References Cited

U.S. PATENT DOCUMENTS

| | | | | |
|---|---|---|---|---|
| 2017/0168031 | A1* | 6/2017 | Verenchikov | H01J 49/067 |
| 2018/0138008 | A1* | 5/2018 | Hahto | H01J 37/3171 |
| 2018/0269053 | A1* | 9/2018 | Jaeschke | H01J 49/0009 |

FOREIGN PATENT DOCUMENTS

| | | | |
|---|---|---|---|
| JP | H05-047344 | A | 2/1993 |
| JP | H07-169426 | A | 7/1995 |
| JP | 2002-025797 | A | 1/2002 |
| JP | 2002-216700 | A | 8/2002 |
| JP | 2006-073359 | A | 3/2006 |
| JP | 2007-048742 | A | 2/2007 |
| JP | 2014-207131 | A | 10/2014 |
| TW | 201133537 | A1 | 10/2011 |

* cited by examiner

PARTICLE ACCELERATION SYSTEM AND PARTICLE ACCELERATION SYSTEM ADJUSTMENT METHOD

RELATED APPLICATIONS

The contents of International Patent Application No. PCT/JP2017/002530, on the basis of each of which priority benefits are claimed in an accompanying application data sheet, is in their entirety incorporated herein by reference.

BACKGROUND

Technical Field

A certain embodiment of the present invention relates to a particle acceleration system and an adjustment method of a particle acceleration system.

Description of Related Art

In the related art, a particle acceleration system including an ion source that generates an ion, an accelerator that accelerates the ion, and a transporting unit that transports the ion from the ion source to the accelerator is known (for example, refer to the related art). In such a particle acceleration system, a magnetic field is formed in the ion source, and electrons and gas molecules are introduced into the ion source. In this case, when the strength of the magnetic field is appropriately adjusted, the electrons are locked in the ion source by the action of the magnetic field. The electrons locked in the ion source collide with the gas molecules. As a result, an ion in the plasma state is generated by the ion source.

When an extraction voltage is applied to an extraction electrode provided in the ion source, the ion is extracted from the ion source with energy corresponding to the extraction voltage. The transporting unit transports the extracted ion. In this case, in a case of transporting the ion via a predetermined reaching target point in the transporting unit, the ion is appropriately guided by the transporting unit and thus can reach the accelerator. For this reason, a positional relationship, in which the ion source and the transporting unit are attached to each other, is set such that the ion, which is extracted from the ion source and is being transported, goes through the reaching target point.

SUMMARY

According to an aspect of the present invention, there is provided a particle acceleration system including an ion source that generates an ion, an accelerator that accelerates the ion, and a transporting unit that transports the ion from the ion source to the accelerator. An attachment angle and an attachment position of the ion source with respect to the transporting unit are able to be adjusted.

According to another aspect of the present invention, there is provided an adjustment method of a particle acceleration system, which includes an ion source that generates an ion, an accelerator that accelerates the ion, and a transporting unit that transports the ion from the ion source to the accelerator. The adjustment method of a particle acceleration system includes adjusting an attachment angle and an attachment position of the ion source, for attaching the ion source to the transporting unit, according to a species of the ion.

DETAILED DESCRIPTION

Figure 1:
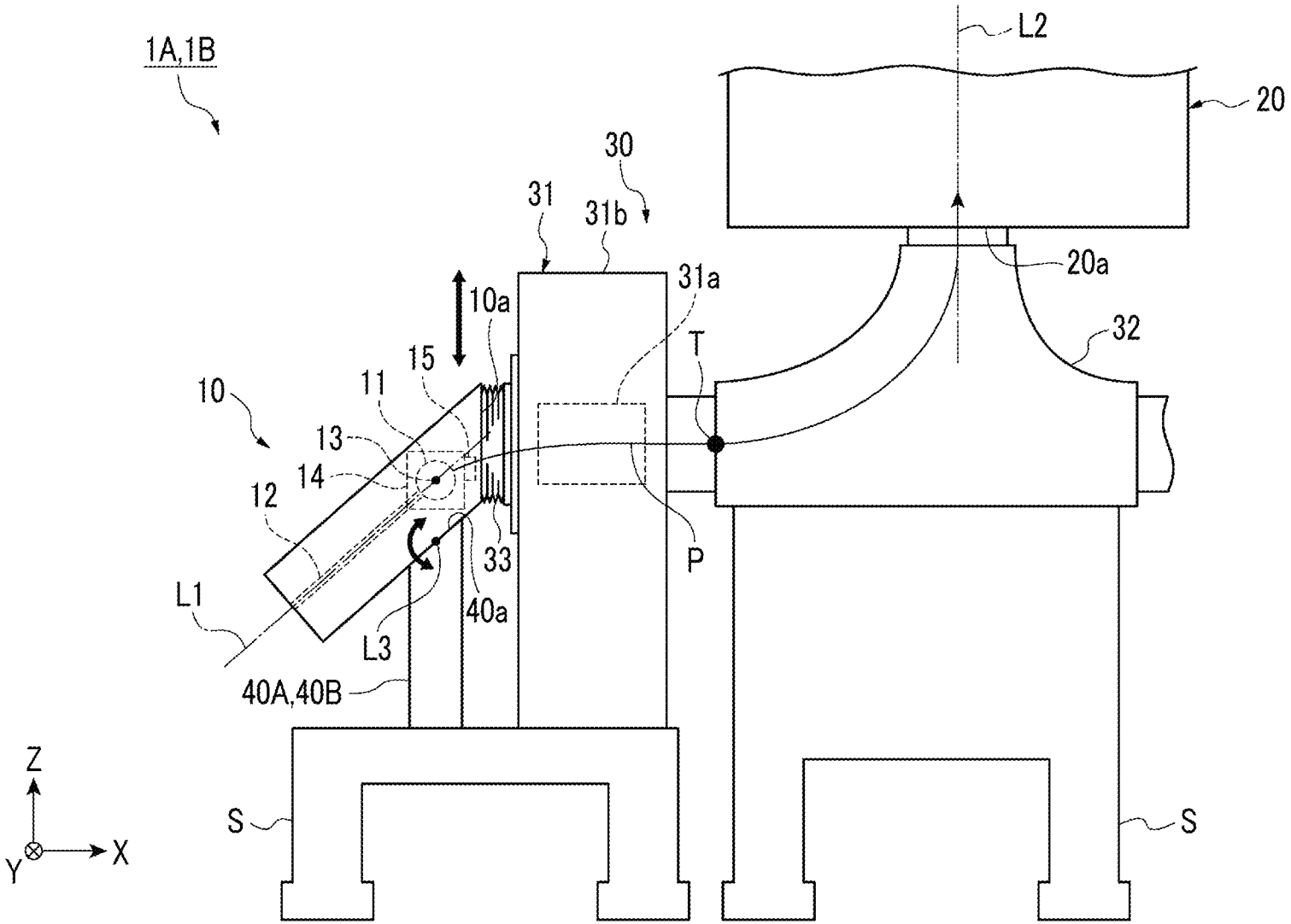
FIG. 1 is a front view illustrating a particle acceleration system according to an embodiment of the present invention.

In a case where an ion source can generate a plurality of species of ions, it is necessary for the strength of a magnetic field to be changed according to an ion species, in order for each of the plurality of species of ions to be transported via the same reaching target point. However, when the strength of the magnetic field is changed, there is a possibility that a plasma state in the ion source is affected and thereby ions cannot be generated.

In the present invention, it is desirable to provide a particle acceleration system and an adjustment method of a particle acceleration system, in which ions can be generated and the ions can be transported to an accelerator regardless of an ion species.

In the particle acceleration system and the adjustment method of a particle acceleration system, the attachment angle and the attachment position of the ion source with respect to the transporting unit are adjusted according to an ion species. Accordingly, the transport passage of the ion is appropriately adjusted according to an ion species. Therefore, without changing the strength of a magnetic field, which is appropriately adjusted such that electrons can be locked in the ion source, the ion extracted from the ion source with desired energy can be transported via a predetermined reaching target point in the transporting unit, and can reach the accelerator. Therefore, regardless of an ion species, the ion can be generated, and the ion can be transported to the accelerator.

In the particle acceleration system according to the aspect of the present invention, a supporting unit that supports the ion source may be further included, and the supporting unit may be detachable with respect to the ion source. In this case, a plurality of members, which can support the ion source in different states from each other in terms of the attachment angle and the attachment position of the ion source with respect to the transporting unit, are prepared as the supporting unit. Thus, according to an ion species, any one of the plurality of members is selected, and the selected member is usable as the supporting unit. Accordingly, the transport passage of the ion is appropriately adjusted according to an ion species. Therefore, simply by detaching the supporting unit according to an ion species, the attachment angle and the attachment position of the ion source with respect to the transporting unit can be easily adjusted.

In the particle acceleration system according to the aspect of the present invention, a supporting unit that supports the ion source may be further included, and the supporting unit may be capable of adjusting the attachment angle by rotating the ion source with respect to the transporting unit and be capable of adjusting the attachment position of the ion source in a direction intersecting a transport direction of the ion in the transporting unit. In this case, the supporting unit can adjust the attachment angle and the attachment position of the ion source with respect to the transporting unit according to an ion species. Accordingly, the transport passage of the ion is appropriately adjusted according to an ion species. Therefore, the attachment angle and the attachment position of the ion source with respect to the transporting unit can be easily adjusted.

Hereinafter, suitable embodiments of the present invention will be described in detail with reference to the drawings. The same or corresponding portions in each drawing will be assigned with the same reference signs, and overlapping description thereof will be omitted.

One Embodiment

FIG. 1 is a front view illustrating a particle acceleration system according to an embodiment of the present invention. As illustrated in FIG. 1, a particle acceleration system 1A includes an ion source 10, an accelerator 20, a transporting unit 30, and a supporting unit 40A. In the following description, an up-and-down direction of a device in a state where the particle acceleration system 1A is placed on a horizontal surface will be referred to as a Z-axis direction, a direction which is in a plane including an ion transport passage P to be described later and is perpendicular to the Z-axis direction will be referred to as an X-axis direction, and a direction perpendicular to the Z-axis direction and the X-axis direction will be referred to as a Y-axis direction. The particle acceleration system 1A is a system that generates and accelerates, ions, for example, α-particles, protons, and deuterons. The particle acceleration system 1A supplies the accelerated ions to a device that performs, for example, positron emission tomography (PET) and boron neutron capture therapy (BNCT).

In the particle acceleration system 1A, the ion source 10 and the accelerator 20 are connected to each other by the transporting unit 30. The ion source 10, the accelerator 20, and the transporting unit 30 are disposed on a ZX-plane. The transporting unit 30 is disposed on an X-axis positive direction side with respect to the ion source 10, and the accelerator 20 is disposed on a Z-axis positive direction side of the transporting unit 30. In addition, the supporting unit 40A is provided below the ion source 10 (in a Z-axis negative direction). The particle acceleration system 1A is placed on a stand S.

The ion source 10 is a device that generates ions in a plasma state from gas molecules. The ion source 10 can generate a plurality of ion species. The ion source 10 can generate, for example, α-particles from helium, and can generate protons from hydrogen. The ion source 10 may not necessarily be capable of generating α-particles and protons.

The ion source 10 is an external ion source provided outside the accelerator 20. The ion source 10 has a substantially cylindrical shape, and a central axis L1 thereof is positioned in the ZX-plane. There is an end surface 10*a* obliquely inclined to the central axis L1, at one end of the ion source 10 in an extending direction. The ion source 10 is disposed such that the end surface 10*a* becomes a substantially vertical surface. The end surface 10*a* opposes an outer surface of a housing 31*b* (to be described in detail later) of an einzel lens 31 of the transporting unit 30, which is on an X-axis negative direction side. The central axis L1 of the ion source 10 is disposed such that one end side, which is an end surface 10*a* side, is at a position higher than the other end side in the Z-axis direction in the ZX-plane. The ion source 10 includes a vacuum box 11, a gas molecule flow passage 12, an electrode 13, electromagnets 14, and an extraction electrode 15.

Figure 2:
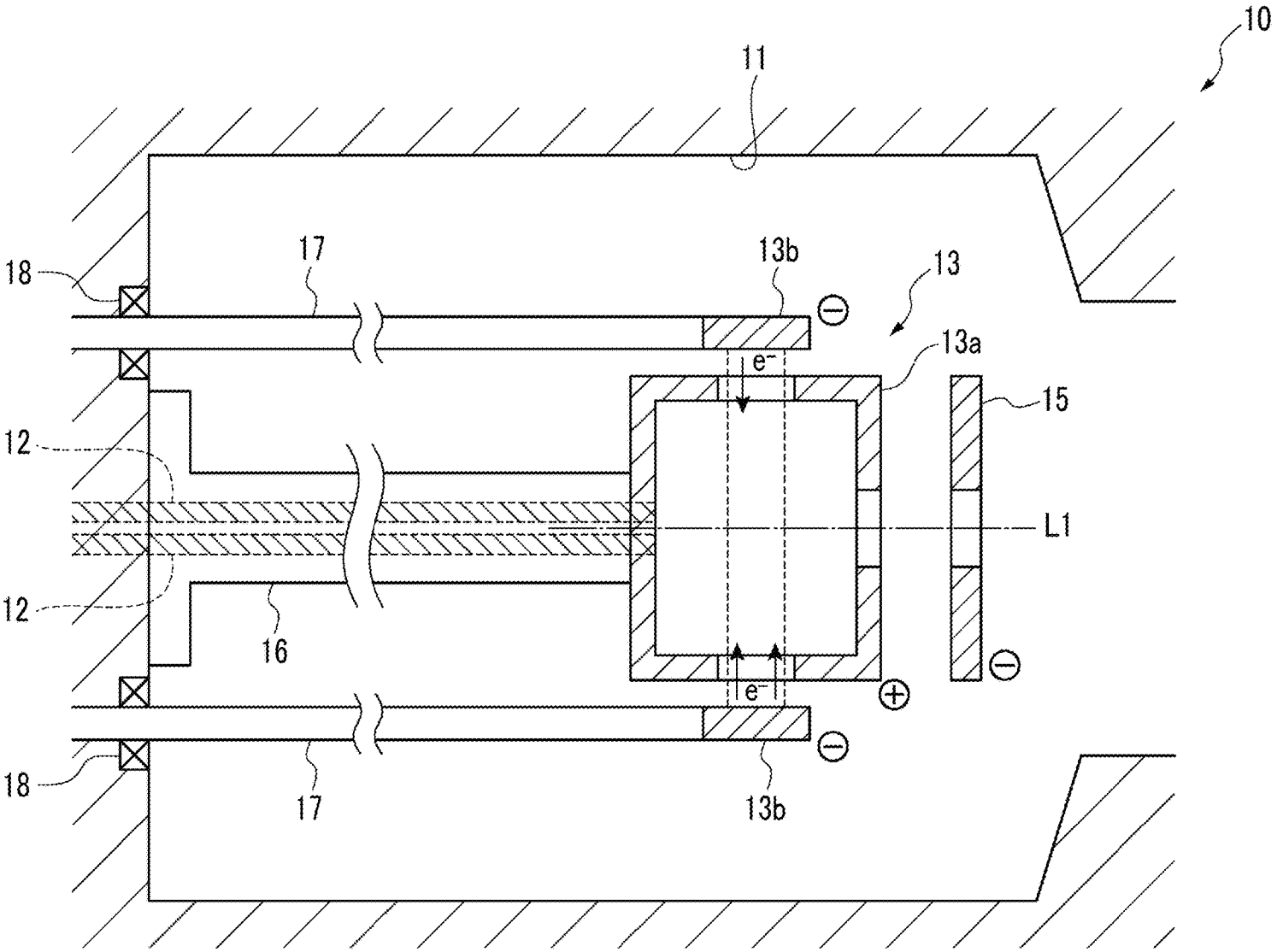
FIG. 2 is a sectional view illustrating an internal structure of an ion source of FIG. 1.

FIG. 2 is a sectional view illustrating an internal structure of the ion source of FIG. 1. As illustrated in FIGS. 1 and 2, a space for locking ions in is formed inside the vacuum box 11. The vacuum box 11 is disposed inside the ion source 10. The vacuum box 11 is connected to a vacuum pump (not illustrated), and can keep the inside thereof in a vacuum state. The vacuum box 11 introduces gas molecules into the inside thereof via the gas molecule flow passage 12. For example, in a case where α-particles are generated as ions, helium is used as gas molecules. In a case of generating ions other than α-particles, gas molecules corresponding to the ions are used.

The electromagnets 14 each are for forming a magnetic field in the vacuum box 11. The electromagnets 14 are provided to form a pair on both sides of the vacuum box 11 in the Y-axis direction. Accordingly, the electromagnets 14 form a magnetic field in a direction substantially along the Y-axis direction in the vacuum box 11. By appropriately adjusting the strength of the magnetic field formed in the vacuum box 11, the electromagnets 14 lock electrons in the vacuum box 11 by the action of the magnetic field.

The electrode 13 supplies electrons into the vacuum box 11, for example, through thermal electron emission. The electrode 13 is supported with respect to the vacuum box 11 by a support 16, and is provided in the vacuum box 11. For example, the electrode is provided near the middle of the vacuum box 11 when seen in the Y-axis direction. The electrode 13 includes a cylindrical anode 13*a* and a pair of cathodes 13*b* and 13*b*, which is provided to sandwich the anode 13*a* therebetween in a direction intersecting the central axis L1. The cathodes 13*b* are connected to cooling pipes 17, are supported with respect to the vacuum box 11 by the cooling pipes 17, and are cooled by a refrigerant circulating in the cooling pipes 17. A vacuum seal 18 is disposed at a contact point between the cooling pipe 17 and the vacuum box 11. A cylinder axis direction of the anode 13*a* may be a direction along the central axis L1 of the ion source 10.

In the electrode 13, electrons ($e^-$) are emitted from one cathode 13*b*, and the electrons reciprocate between the pair of cathodes 13*b* and 13*b*. At this time, when the electromagnet 14 generates a magnetic field in the cylinder axis direction of the anode 13*a*, the electrons are locked in the anode 13*a* without colliding with the anode 13*a* while moving helically. By the electrons, which reciprocate between the pair of cathodes 13*b* and 13*b* in the anode 13*a*, colliding with gas molecules such as helium introduced in through the gas molecule flow passage 12, ions such as α-particles are generated.

By an extraction voltage being applied, the extraction electrode 15 extracts the ions from the vacuum box 11. The extraction electrode 15 extracts the ions from the vacuum box 11 with energy corresponding to the applied extraction voltage. The extraction electrode 15 is provided in the vicinity of the anode 13*a*. The ions extracted from the vacuum box 11 pass through an opening formed in the end surface 10*a* of the ion source 10, and are transported to a transporting unit 30 side to be described later.

In the ion source 10 configured in such a manner, gas molecules are introduced into the vacuum box 11, which is brought into the vacuum state by the vacuum pump, via the gas molecule flow passage 12. In addition, the electrode 13 supplies electrons into the vacuum box 11. In this case, when a magnetic field is formed in the vacuum box 11 by being energized by the electromagnet 14 and the strength and a direction of the magnetic field is appropriately adjusted, the electrons are locked in the vacuum box 11 by the action of the magnetic field. When the electrons locked in the vacuum box 11 collide with the gas molecules, the gas molecules are ionized and ions are generated in the plasma state. When the extraction voltage is applied to the extraction electrode 15, the ions are extracted from the vacuum box 11 with energy corresponding to the extraction voltage.

As illustrated in FIG. 1, the accelerator 20 is a device that accelerates the ions generated by the ion source 10 and makes a charged particle ray. In the embodiment, a cyclotron is given as an example of the accelerator 20. Without being limited to the cyclotron, the accelerator 20 may be a synchrotron, a synchrocyclotron, and a linac.

The accelerator 20 has a substantially cylindrical shape, and a central axis L2 thereof is disposed in an orientation of extending in the Z-axis direction. The accelerator 20 is disposed at a position even higher than the ion source 10 in the Z-axis direction. When ions to be accelerated are incident into a predetermined position in the accelerator 20, the accelerator 20 accelerates the ions. In the accelerator 20, the ions to be accelerated are incident into an incident portion 20*a* open to a center portion of a lower surface (surface in the Z-axis negative direction) side of the accelerator 20. The central axis L2 of the accelerator 20 may not extend in the Z-axis direction. For example, the central axis L2 may extend in the X-axis direction in a state where the entire particle acceleration system 1A illustrated in FIG. 1 is rotated by 90° about a Y-axis. In addition, the central axis L2 may extend in the Y-axis direction in a state where the entire particle acceleration system 1A illustrated in FIG. 1 is rotated by 90° about an X-axis. In this case, the central axis L1 of the ion source 10 is positioned in an XY-plane.

The transporting unit 30 transports the ions generated by the ion source 10 to the accelerator 20 from the ion source 10. The transporting unit 30 includes the einzel lens 31, a deflection electromagnet 32, and a bellows 33.

The einzel lens 31 is for focusing the transported ions. The einzel lens 31 includes a lens portion 31*a* and the box-shaped housing 31*b* accommodating the lens portion 31*a*. The lens portion 31*a* is configured with three electrodes, to which positive and negative potentials are alternately applied, and focuses the ions passing therethrough by means of an electric field formed by the electrodes. The outer surface of the housing 31*b* on an ion source 10 side (X-axis negative direction side) opposes the end surface 10*a* of the ion source 10, and is connected to the end surface 10*a* by the flexible bellows 33. In addition, an outer surface of the housing 31*b*, which is on an opposite side (X-axis positive direction side) to the ion source 10 side, is directly connected to the deflection electromagnet 32.

The deflection electromagnet 32 generates a magnetic field, and bends a transport direction of the ions passing through the einzel lens 31 in the ZX-plane by means of the magnetic field. Specifically, the deflection electromagnet 32 bends the transport direction of the ions, which pass through the einzel lens 31 and are transported in an X-axis positive direction, to a Z-axis positive direction. Accordingly, the deflection electromagnet 32 guides the ions to the incident portion 20*a* of the accelerator 20.

A leaked magnetic field, which is a magnetic field leaked from the vacuum box 11, is formed in the transporting unit 30, for example, inside the bellows 33 and the einzel lens 31. For this reason, the actual transport passage P of ions transported by the transporting unit 30 is curved by the action of the leaked magnetic field. Specifically, the transport passage P of the ions is gradually curved from an obliquely upward direction, which is a composite direction between the X-axis positive direction and the Z-axis positive direction, toward the X-axis positive direction by the action of the leaked magnetic field. The strength of the action of the leaked magnetic field differs according to an ion species and energy. Therefore, in a case of extracting the ions from the ion source 10 with desired energy, the transport passage P of the ions is curved in a trajectory that differs according to an ion species.

A reaching target point T of the ions is set in a predetermined region of the transporting unit 30, which is in a boundary between the housing 31*b* of the einzel lens 31 and the deflection electromagnet 32, in a YZ-plane. In a case where the transporting unit 30 transports the ions via the reaching target point T, the reaching target point T is a region through which the ions can be appropriately guided and can reach the incident portion 20*a* of the accelerator 20. Although the reaching target point T is set in the boundary between the housing 31*b* of the einzel lens 31 and the deflection electromagnet 32 in the embodiment, the reaching target point may be set to another position according to a configuration of the transporting unit 30 (in particular, the deflection electromagnet 32).

The supporting unit 40A is a mechanism that supports the ion source 10. The supporting unit 40A refers to a plurality of frames that are detachable with respect to the ion source 10. Each of the plurality of frames configuring the supporting unit 40A supports the ion source 10 such that the ion source 10 has different attachment angles and attachment positions with respect to the transporting unit 30 from each other. That is, by replacing the plurality of detachable frames, the supporting unit 40A can adjust the attachment angle and the attachment position of the ion source 10 with respect to the transporting unit 30. On an opposite side to a side connected to the ion source 10, the supporting unit 40A is supported by the stand S.

Herein, the attachment angle of the ion source 10 with respect to the transporting unit 30 is an angle formed between the Z-axis direction and the central axis L1 of the ion source 10 (a tilt angle of the central axis L1 with respect to the Z-axis direction) in a state where the ion source 10 is attached to the transporting unit 30 (that is, a state where the ion source 10 supported by the supporting unit 40A is attached to the housing 31*b* of the einzel lens 31 via the bellows 33). The attachment angle of the ion source 10 with respect to the transporting unit 30 may be an angle formed between the transport direction of the ions to the reaching target point T and the central axis L1 of the ion source 10 in a state where the ion source 10 is attached to the transporting unit 30, or may be an angle formed between one predetermined direction perpendicular to a direction where the pair of electromagnets 14 provided in the ion source 10 opposes each other and the central axis L1 of the ion source 10.

The attachment position of the ion source 10 with respect to the transporting unit 30 is a position of any one of points of the ion source 10 in the ZX-plane with any one of points of the transporting unit 30 set as reference in a state where the ion source 10 is attached to the transporting unit 30. Specifically, any one of points of the transporting unit 30 may be set to, for example, the reaching target point T, may be set to a middle portion of a connecting portion between the housing 31*b* of the einzel lens 31 and the bellows 33, or may be set to the center of gravity of the transporting unit 30. In addition, any one of points of the ion source 10 may be set to, for example, a middle portion of the pair of electromagnets 14, which is seen from the direction where the pair of electromagnets 14 opposes each other, may be set to a middle portion of the end surface 10*a* of the ion source 10, or may be set to the center of gravity of the ion source 10.

Each of the plurality of frames configuring the supporting unit 40A has, for example, a columnar shape, and extends in a substantially vertical direction (Z-axis direction). When used as the supporting unit 40A, each of the plurality of frames is connected to the ion source 10 on an upper end side thereof, and is connected to the stand S on a lower end side thereof. A supporting surface 40*a* for placing and fixing the ion source 10 to the upper end side thereof is formed in each of the plurality of frames. The supporting surface 40*a* is formed by being inclined with respect to the Z-axis direction, and the attachment angle of the ion source 10 is determined according to this inclination angle. The plurality of frames respectively include the supporting surfaces 40*a* having inclination angles different from each other. For this reason, the attachment angle of the ion source 10 with respect to the transporting unit 30 differs according to a frame selected as the supporting unit 40A. The supporting unit 40A is not limited to a configuration where the attachment angle changes as the inclination angle of the supporting surface 40*a* differs for each of the plurality of frames.

In addition, the plurality of respective frames have lengths in the extending direction different from each other. For this reason, the attachment position of the ion source 10 with respect to the transporting unit 30 differs according to a frame selected as the supporting unit 40A. The supporting unit 40A is not limited to a configuration where the attachment position changes as the lengths in the extending direction differ from each other for each of the plurality of frames.

Figure 3A:
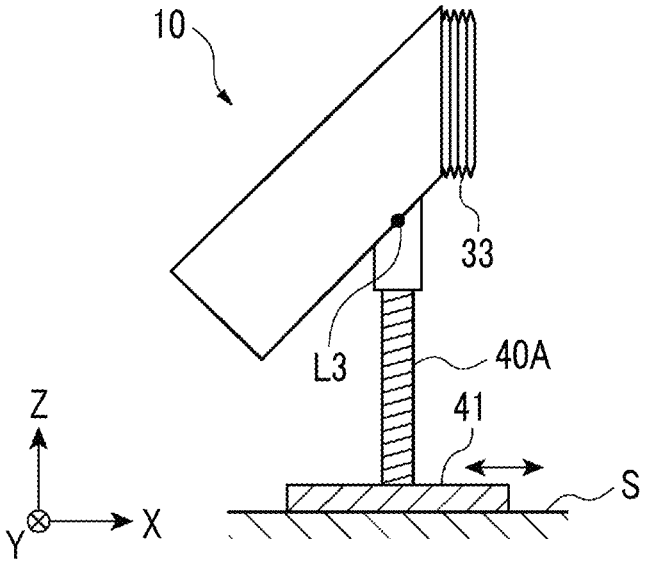
FIGS. 3A and 3B are views illustrating a modification example of a supporting unit.
Figure 3B:
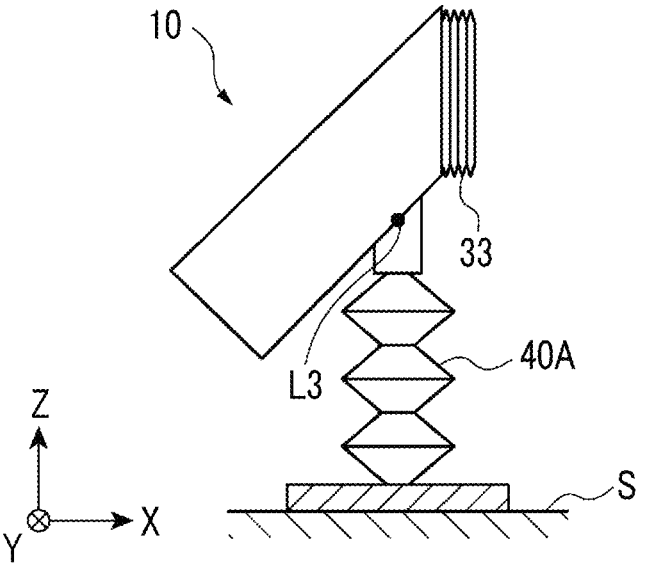

The supporting unit 40A is not limited to a frame insofar as the ion source 10 can be supported. Herein, FIGS. 3A and 3B are views illustrating a modification example of the supporting unit 40A. For example, the supporting unit 40A may be a ball screw mechanism as illustrated in FIG. 3A. Herein, the supporting unit 40A is disposed, for example, on a movable stage 41 that is movable in the X-axis direction. Alternatively, the supporting unit 40A may be a link mechanism or a bellows as illustrated in FIG. 3B.

Next, an operation of the particle acceleration system 1A and an adjustment method of the particle acceleration system 1A according to the embodiment will be described.

Figure 4:
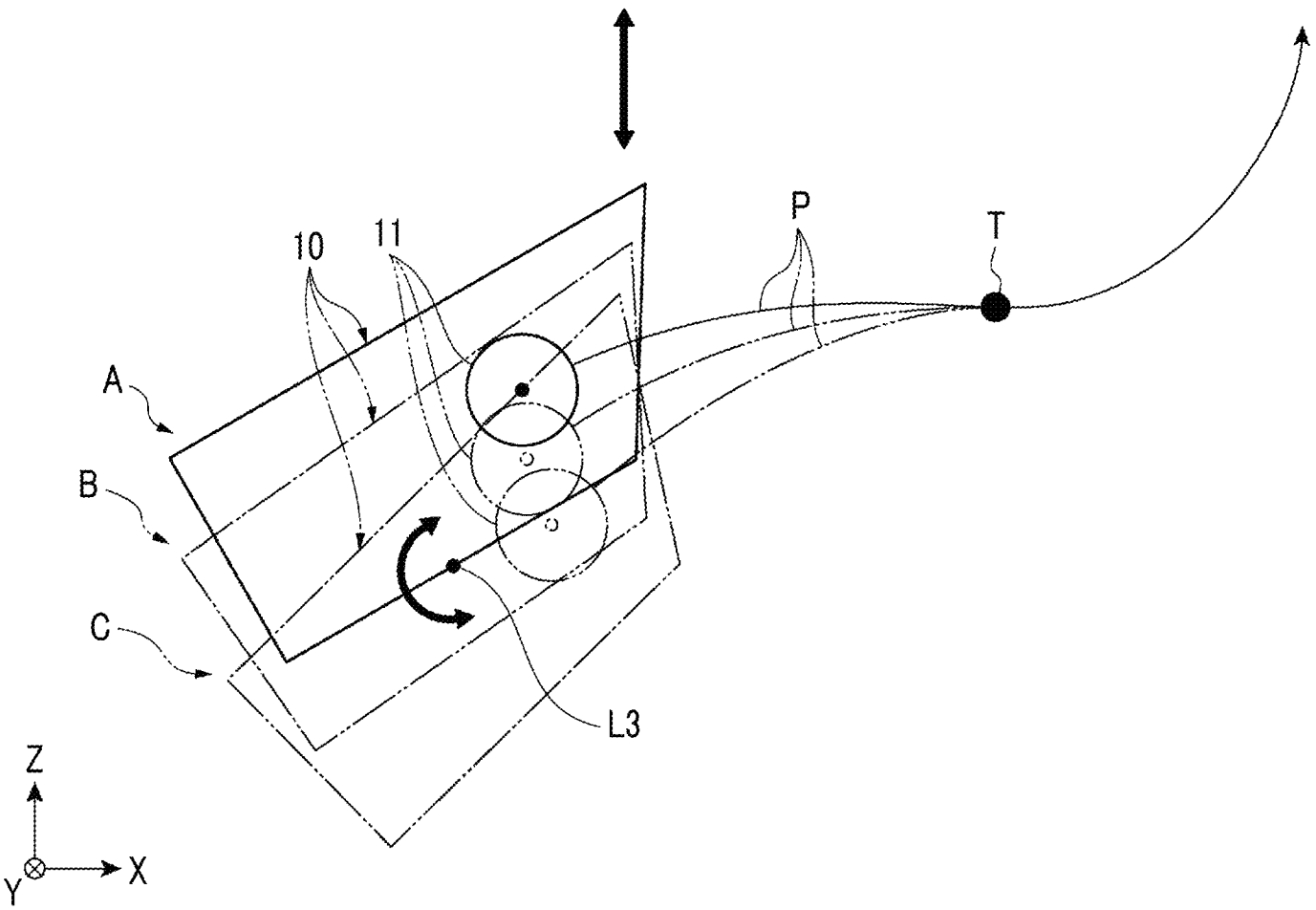
FIG. 4 is a view schematically illustrating an attachment angle and an attachment position of the ion source with respect to a transporting unit.

A case of generating α-particles from helium will be described as an example. FIG. 4 is a view schematically illustrating an attachment angle and an attachment position of the ion source with respect to the transporting unit. As illustrated in FIGS. 1 and 4, first, the supporting unit 40A is detached and replaced with a frame for α-particles, and the ion source 10 is brought into a state of being supported by the frame for α-particles (refer to a state A in FIG. 4). In a case where the supporting unit 40A is replaced with the frame for α-particles as described above, and when ions transported by the transporting unit 30 are α-particles, the ions are transported through the transport passage P of the ions, the transport passage going through the reaching target point T.

Specifically, when the transporting unit 30 transports the α-particles generated by the ion source 10 in the state A, the transport passage is curved in the ZX-plane by the action of the leaked magnetic field. More specifically, the transport passage of the α-particles is gradually curved from the obliquely upward direction, which is the composite direction between the X-axis positive direction and the Z-axis positive direction, toward the X-axis positive direction by the action of the leaked magnetic field. After then, the α-particles are transported via the reaching target point T. Then, the α-particles are guided by the deflection electromagnet 32 from the X-axis positive direction to the Z-axis positive direction, are incident into the incident portion 20*a* of the accelerator 20, and are accelerated.

Next, a case of generating protons from hydrogen will be described as another example. First, the supporting unit 40A is detached and replaced with a frame for protons, and the ion source 10 is brought into a state of being supported by the frame for protons (refer to a state B in FIG. 4). Compared to the state A, in the state B, an angle of the central axis L1 of the ion source 10 is in a steep (has come close to the Z-axis direction) state, and a position of the ion source 10 is in a lower (has moved in the Z-axis negative direction) state. In a case where the supporting unit 40A is replaced with the frame for protons as described above, and when ions transported by the transporting unit 30 are protons, the ions are transported through the transport passage P of the ions, the transport passage going through the reaching target point T.

Specifically, when the transporting unit 30 transports the protons generated by the ion source 10 in the state B, the transport passage is curved in the ZX-plane by the action of the leaked magnetic field. More specifically, the transport passage of the protons is gradually curved from the obliquely upward direction, which is the composite direction between the X-axis positive direction and the Z-axis positive direction, toward the X-axis positive direction by the action of the leaked magnetic field. After then, the protons are transported via the reaching target point T. Then, the protons are guided by the deflection electromagnet 32 from the X-axis positive direction to the Z-axis positive direction, are incident into the incident portion 20*a* of the accelerator 20, and are accelerated. The transport passage P of the protons has a curve in the transport direction of the ions, which has high curvature compared to the transport passage P of the α-particles. For this reason, when the attachment angle and the attachment position of the ion source 10 with respect to the transporting unit 30 are in the state A suitable for α-particles, the protons are transported to a Z-axis negative direction side of the reaching target point T. As a result, the protons cannot be incident into the incident portion 20*a* of the accelerator 20.

A state C in FIG. 4 shows an example of, in a case of generating ions other than α-particles and protons, the attachment angle and the attachment position of the ion source 10 with respect to the transporting unit 30 and the transport passage P of the ions.

As described above, in the particle acceleration system 1A and the adjustment method of the particle acceleration system 1A according to the embodiment, the attachment angle and the attachment position of the ion source 10 with respect to the transporting unit 30 are adjusted according to an ion species. Accordingly, the transport passage P of the ions is appropriately adjusted according to an ion species. Therefore, without changing the strength of a magnetic field, which is appropriately adjusted such that electrons can be locked in the ion source 10, the ions extracted from the ion source 10 with desired energy can be transported via the predetermined reaching target point T in the transporting unit 30, and can reach the accelerator 20. Therefore, regardless of an ion species, ions can be generated and the ions can be transported to the accelerator 20.

In addition, the particle acceleration system 1A according to the embodiment includes the supporting unit 40A that supports the ion source 10, and the supporting unit 40A is detachable with respect to the ion source 10. The plurality of members, which can support the ion source in different states from each other in terms of the attachment angle and the attachment position of the ion source 10 with respect to the transporting unit 30, are prepared as the supporting unit 40A. For this reason, according to an ion species, any one of the plurality of members is selected, and the selected member is usable as the supporting unit 40A. Accordingly, the transport passage P of the ions is appropriately adjusted according to an ion species. Therefore, simply by detaching the supporting unit 40A according to an ion species, the attachment angle and the attachment position of the ion source 10 with respect to the transporting unit 30 can be easily adjusted.

Another Embodiment

A particle acceleration system 1B according to another embodiment is different from the particle acceleration system 1A according to the one embodiment in terms of a configuration of the supporting unit. Hereinafter, a configuration of a supporting unit 40B according to another will be described.

The supporting unit 40B is a frame that can adjust the attachment angle by rotating the ion source 10 with respect to the transporting unit 30 and can adjust the attachment position of the ion source 10 in a direction intersecting the transport direction of ions in the transporting unit 30. The supporting unit 40B supports the ion source 10 to be rotatable about a rotation axis L3. The rotation axis L3 is set to the Y-axis direction. The supporting unit 40B has, for example, a columnar shape, and extends in the substantially vertical direction (Z-axis direction). The frame is connected to the ion source 10 on an upper end side thereof, and is connected to the stand S on a lower end side thereof. The frame includes a supporting shaft (not illustrated) on the upper end side thereof, and the ion source 10 is rotatably connected to the supporting shaft. That is, the rotation axis L3 matches the center of the supporting shaft. By rotating about the supporting shaft, the attachment angle of the ion source 10 with respect to the transporting unit 30 changes. The supporting unit 40B may include the supporting shaft (that is, the rotation axis) on the lower end side of the frame, and the stand S may be connected to the supporting shaft thereof. Alternatively, the supporting unit 40B may include supporting shafts on both of the upper end side and the lower end side, and the supporting shafts may be rotatably connected to the ion source 10 and the stand S respectively.

In addition, the frame has an expanding and contracting mechanism that expands and contracts in the extending direction. The frame is configured to be capable of expanding and contracting by a hollow columnar member doubly overlapping, and to be able to be fixed by a bolt at a desired length. The expanding and contracting mechanism of the frame is not limited to this configuration, and may be configured to expand and contract, for example, by a hydraulic cylinder, an electric cylinder, a ball screw, a linear guide, a belt mechanism, and a link mechanism. In addition, a direction where the supporting unit 40B expands and contracts is not limited to the extending direction of the frame.

When the supporting unit 40B adjusts the attachment angle by rotating the ion source 10 with respect to the transporting unit 30, the transport direction of ions generated by the ion source 10 in the transporting unit 30 follows a change in the attachment angle of the ion source 10, and changes in the ZX-plane. In addition, when the supporting unit 40B adjusts the attachment angle of the ion source 10 in the direction intersecting the transport direction of the ions in the transporting unit 30, the transport direction of the ions generated by the ion source 10 in the transporting unit 30 follows a change in the attachment position of the ion source 10, and changes in the ZX-plane.

According to an ion species, the supporting unit 40B configured in such a manner adjusts the attachment angle by rotating the ion source 10 with respect to the transporting unit 30 and adjusts the attachment position of the ion source 10 in the direction intersecting the transport direction of the ions in the transporting unit 30. Accordingly, the ions can be transported by the transporting unit 30 through the transport passage P via the reaching target point T.

As described above, the particle acceleration system 1B according to the embodiment includes the supporting unit 40B that supports the ion source 10. The supporting unit 40B can adjust the attachment angle by rotating the ion source 10 with respect to the transporting unit 30 and can adjust the attachment position of the ion source 10 in the direction intersecting the transport direction of the ions in the transporting unit 30. For this reason, the supporting unit 40B can adjust the attachment angle and the attachment position of the ion source 10 with respect to the transporting unit 30 according to an ion species. Accordingly, the transport passage P of the ions is appropriately adjusted according to an ion species. Therefore, the attachment angle and the attachment position of the ion source 10 with respect to the transporting unit 30 can be easily adjusted.

Although the present invention is specifically described based on the embodiments hereinbefore, the present invention is not limited to the embodiments. For example, in the embodiments, the ion source 10 is provided only on one side of the particle acceleration systems 1A and 1B in the X-axis direction. However, the ion source 10 may be provided also on the other side of the particle acceleration systems 1A and 1B in the X-axis direction.

In addition, in another embodiment, the supporting unit 40B may be configured to perform rotation and movement, for example, by a drive mechanism including a motor. In this case, the attachment angle and the attachment position of the ion source 10 with respect to the transporting unit 30 can be more easily adjusted.

It should be understood that the invention is not limited to the above-described embodiment, but may be modified into various forms on the basis of the spirit of the invention. Additionally, the modifications are included in the scope of the invention.

What is claimed is:

1. A particle acceleration system comprising:

an ion source that generates an ion;

an accelerator that accelerates the ion; and a transporting unit that transports the ion from the ion source to the accelerator, the accelerator being provided outside the transporting unit, wherein an attachment angle and an attachment position of the ion source with respect to the transporting unit are able to be adjusted, according to a species of the ion, so as to adjust a passage of the ion in the transporting unit, wherein the ion source includes an electrode that supplies electrons, a deflection magnet that generates a magnetic field so as to lock the electrons, and a flow passage so as to introduce a gas molecule being capable of colliding with the electrons so that the ion is generated.

2. The particle acceleration system according to claim 1, further comprising:

a supporting unit that supports the ion source, wherein the supporting unit is detachable with respect to the ion source.

3. The particle acceleration system according to claim 1, further comprising:

a supporting unit that supports the ion source, wherein the supporting unit is capable of adjusting the attachment angle by rotating the ion source with respect to the transporting unit and is capable of adjusting the attachment position of the ion source in a direction intersecting a transport direction of the ion in the transporting unit.

4. The particle acceleration system according to claim 1, wherein the ion source is capable of generating a plurality of species of ions.

5. An adjustment method of a particle acceleration system including an ion source that generates an ion, an accelerator that accelerates the ion, and a transporting unit that transports the ion from the ion source to the accelerator, the accelerator being provided outside the transporting unit, the adjustment method comprising:

adjusting an attachment angle and an attachment position of the ion source, for attaching the ion source to the transporting unit, according to a species of the ion, so as to adjust a passage of the ion in the transporting unit, wherein the ion source includes an electrode that supplies electrons, a deflection magnet that generates a magnetic field so as to lock the electrons, and a flow passage so as to introduce a gas molecule being capable of colliding with the electrons so that the ion is generated.

* * * * *